US007793908B1

(12) United States Patent
Finegan, Jr.

(10) Patent No.: US 7,793,908 B1
(45) Date of Patent: Sep. 14, 2010

(54) AIR HANDLER SUPPORT SYSTEM

(76) Inventor: Stephen E. Finegan, Jr., 3077 S. Franklin Ter., Inverness, FL (US) 34450

( * ) Notice: Subject to any disclaimer, the term of this patent is extended or adjusted under 35 U.S.C. 154(b) by 396 days.

(21) Appl. No.: 12/004,844

(22) Filed: Dec. 21, 2007

(51) Int. Cl.
*A47H 1/10* (2006.01)

(52) U.S. Cl. ..... 248/317; 248/637; 248/638; 248/610

(58) Field of Classification Search ..... 248/638, 248/317, 323, 326, 610, 637, 674, 675, 235, 248/241, 295.11, 297.31; 182/82; 62/295, 62/297
See application file for complete search history.

(56) References Cited

U.S. PATENT DOCUMENTS 4,957,185 A * 9/1990 Courchesne et al. ..... 182/150
5,396,782 A 3/1995 Ley
5,400,993 A * 3/1995 Hamilton ..... 248/279.1
6,053,280 A * 4/2000 Smith et al. ..... 182/82
6,457,692 B1 * 10/2002 Gohl, Jr. ..... 248/317
6,460,817 B1 * 10/2002 Bosson ..... 248/317
6,886,662 B2 * 5/2005 Riley ..... 182/82
7,128,302 B2 10/2006 Dubensky et al.
7,172,166 B2 * 2/2007 Wang ..... 248/317

* cited by examiner

*Primary Examiner*—Anita M King

(57) ABSTRACT

Two similarly configured upper brackets are each formed of an inverted L-shaped fixed component above and an L-shaped adjustable component below. Each fixed component has a horizontal leg above and a vertical leg below. Each horizontal leg has laterally spaced vertical support holes. Each vertical leg has elevationally space adjustment holes. Each adjustable component has a horizontal leg below and a vertical leg above. Each vertical leg has laterally spaced horizontal support holes adjacent to the horizontal leg. Each vertical leg has elevationally spaced adjustment holes. Each leg is sized to allow the vertical leg of each adjustable component to slidably receive the vertical leg of an associated fixed component to align the holes in the legs selectively with adjustment elements extending through aligned holes. The horizontal leg of each adjustable component has an upper surface to provide an upper support surface for an air handler.

5 Claims, 3 Drawing Sheets

AIR HANDLER SUPPORT SYSTEM

BACKGROUND OF THE INVENTION

1. Field of the Invention

The present invention relates to an air handler support system and more particularly pertains to suspending air handler components of an air condition in a safe, convenient and economical manner.

2. Description of the Prior Art

The use of air handler support systems is known in the prior art. More specifically, air handler support systems previously devised and utilized for the purpose of suspending air handlers are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,396,782 issued Mar. 14, 1995 to Ley discloses an Integral Suspension System and U.S. Pat. No. 7,128,302 issued Oct. 31, 2006 to Dubensky et al. discloses a Vibrationally Isolated Support Construction for an Air Handling Unit.

While the aforementioned devices fulfill their particular objectives and requirements, they do not describe an air handler support system that allows suspending air handler components of an air condition in a safe, convenient and economical manner.

In this respect, the air handler support system according to the present invention substantially departs from the conventional concepts and designs of the prior art, and in doing so provides an apparatus primarily developed for the purpose of suspending air handler components of an air condition in a safe, convenient and economical manner.

Therefore, it can be appreciated that there exists a continuing need for a new and improved air handler support system which can be used for suspending air handler components of an air condition in a safe, convenient and economical manner. In this regard, the present invention substantially fulfills this need.

SUMMARY OF THE INVENTION

In view of the foregoing disadvantages inherent in the known types of air handler support systems now present in the prior art, the present invention provides an improved air handler support system. As such, the general purpose of the present invention, which will be described subsequently in greater detail, is to provide a new and improved air handler support system and method which has all the advantages of the prior art and none of the disadvantages.

To attain this, the present invention essentially comprises two similarly configured upper brackets are provided. Each upper bracket is formed of an inverted L-shaped fixed component above and an L-shaped adjustable component.

Each fixed component has a horizontal leg above and a vertical leg below. Bolt plates are secured to the horizontal and vertical legs for retention purposes. Each horizontal leg has two laterally spaced vertical support holes. Each vertical leg has four elevationally space adjustment holes.

Each adjustable component has a horizontal leg below and a vertical leg above. Bolt plates are secured to the horizontal and vertical legs for retention purposes. Each vertical leg has two laterally spaced horizontal support holes adjacent to the horizontal leg. Each vertical leg has two elevationally space adjustment holes. Each leg is tubular with a square cross sectional configuration and is sized to allow the vertical leg of each adjustable component to slidably receive the vertical leg of an associated fixed component to align the holes in the legs selectively for larger and smaller air conditioning components adapted to be supported. A pair of adjustment bolts are provided. The adjustment bolts extend through aligned holes of the vertical legs of the fixed and adjustable components. A nut is provided for each bolt. The horizontal leg of each adjustable component has an upper surface with spaced elastomeric vibration isolator pads. In this manner an upper support surface for supporting air conditioning components is provided.

Two similarly configured L-shaped supplemental components are next provided. The L-shaped supplemental components have a horizontal leg below and a vertical leg above. Bolt plates are secured to the horizontal and vertical legs for retention purposes. Each vertical leg has two elevationally spaced horizontal support holes adjacent to the horizontal leg. Each horizontal leg has three laterally spaced support holes. A pair of securement bolts is provided. The securement bolts extend through aligned holes of the vertical legs of the supplemental components and the adjustable components. A nut is provided for each bolt.

Next provided are a plurality of telescoping cross braces. Each telescoping cross brace is formed of two segments. Each segment is tubular with a square cross sectional configuration and is sized to allow the one segment of each of the cross braces to slidably receive the other segment for varying the length of the cross braces. All of the cross brace segments have an open end with a threaded insert positioned in axial alignment with one of the support holes in the horizontal leg of the supplemental component to provide a lower support surface. All of the cross brace segments and all of the legs of the components are fabricated of a high carbon steel of a grade and size selected for a particular application.

Next provided is an air handler. The air handler is positioned upon the upper support surface. The air handler is totally accessible for maintenance and replacement from the side opposite from the vertical legs of the brackets.

A drain pan is next provided. The drain pan is positioned upon the lower support surface. The drain pan is totally accessible for maintenance and replacement from the side opposite from the vertical legs of the brackets. A drain pan support pin is provided on the vertical leg of each supplemental component above the horizontal leg. The support pin removably retains the drain pan in an operative orientation beneath the air handler.

Lastly, a suspension assembly is provided. The suspension assembly includes two vertically oriented threaded rods. The threaded rods have lower ends extending through the vertical holes of the horizontal leg of each fixed component. An associated nut is beneath the horizontal legs for support. Four hanger bolts are provided. Each hanger bolt has a threaded end which is extendable horizontally into a rafter and a free end with a vertical threaded aperture for threadedly receiving and supporting the upper end of the threaded rod.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved air handler support system which has all of the advantages of the prior art air handler support systems and none of the disadvantages.

It is another object of the present invention to provide a new and improved air handler support system which may be easily and efficiently manufactured and marketed.

It is further object of the present invention to provide a new and improved air handler support system which is of durable and reliable constructions.

An even further object of the present invention is to provide a new and improved air handler support system which is susceptible of a low cost of manufacture with regard to both materials and labor, and which accordingly is then susceptible of low prices of sale to the consuming public, thereby making such air handler support system economically available to the buying public.

Even still another object of the present invention is to provide an air handler support system for suspending air handler components of an air condition in a safe, convenient and economical manner.

Lastly, it is an object of the present invention to provide a new and improved air handler support system having two similarly configured upper brackets each formed of an inverted L-shaped fixed component above and an L-shaped adjustable component below. Each fixed component has a horizontal leg above and a vertical leg below. Each horizontal leg has laterally spaced vertical support holes. Each vertical leg has elevationally space adjustment holes. Each adjustable component has a horizontal leg below and a vertical leg above. Each vertical leg has laterally spaced horizontal support holes adjacent to the horizontal leg. Each vertical leg has elevationally spaced adjustment holes. Each leg is sized to allow the vertical leg of each adjustable component to slidably receive the vertical leg of an associated fixed component to align the holes in the legs selectively with adjustment elements extending through aligned holes. The horizontal leg of each adjustable component has an upper surface to provide an upper support surface for an air handler.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
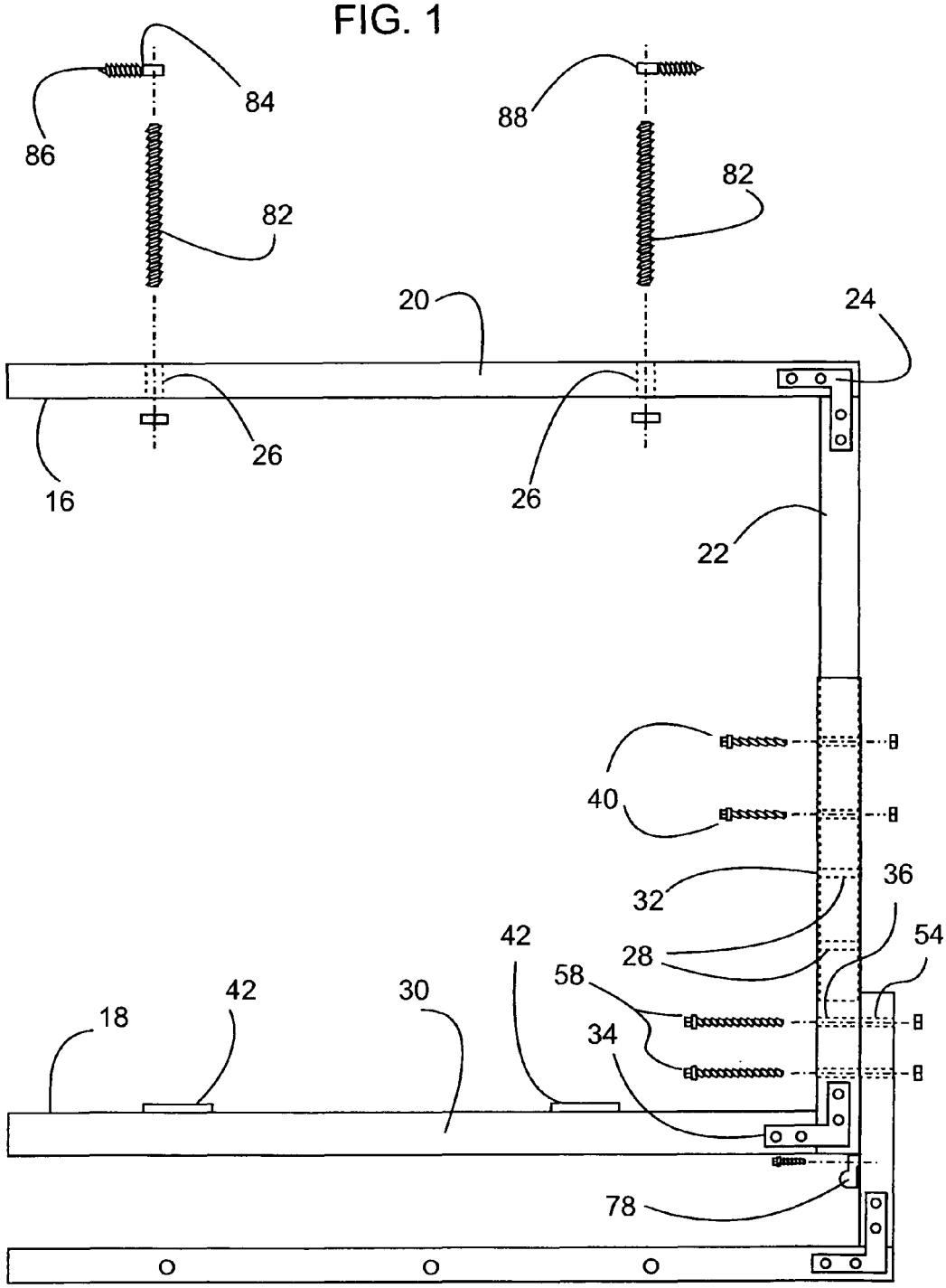
FIG. 1 is a partially exploded side elevational view of one bracket assembly in a contracted orientation for supporting smaller air conditioning components.
Figure 2:
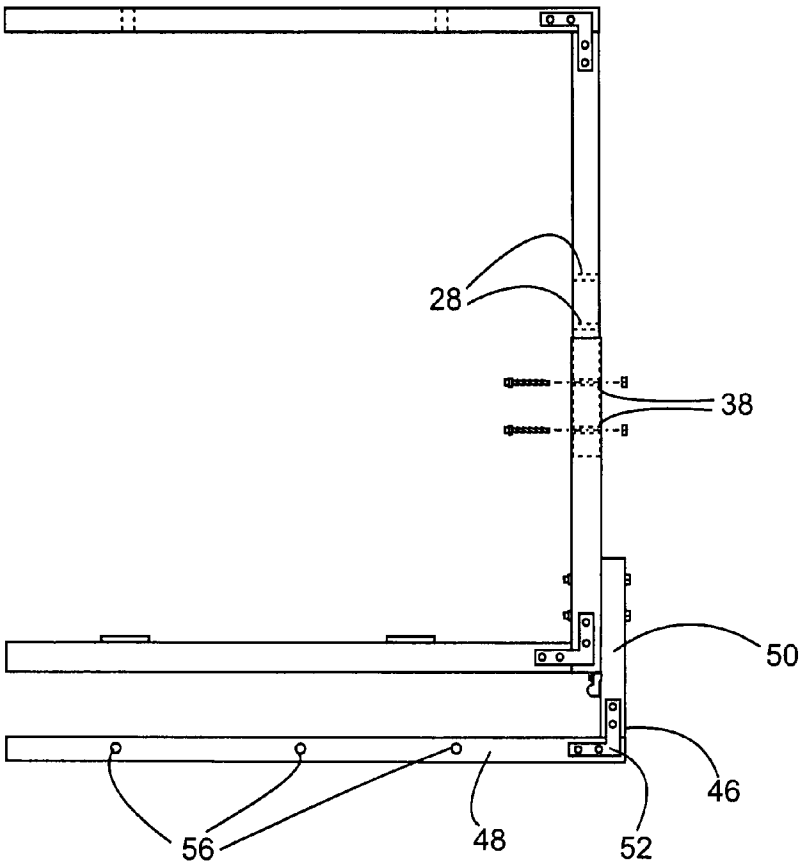
FIG. 2 is a partially exploded side elevational view of one bracket assembly in an expanded orientation for supporting larger air conditioning components.
Figure 3:
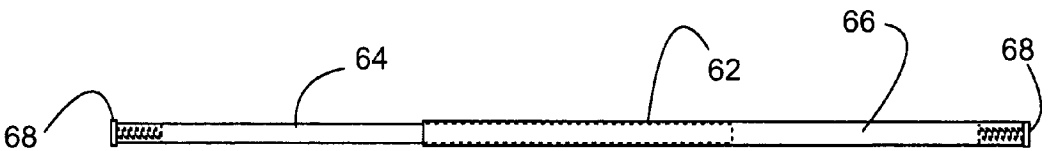
FIG. 3 is a front elevational view of one lower telescoping lower support rod partly in cross section.
Figure 4:
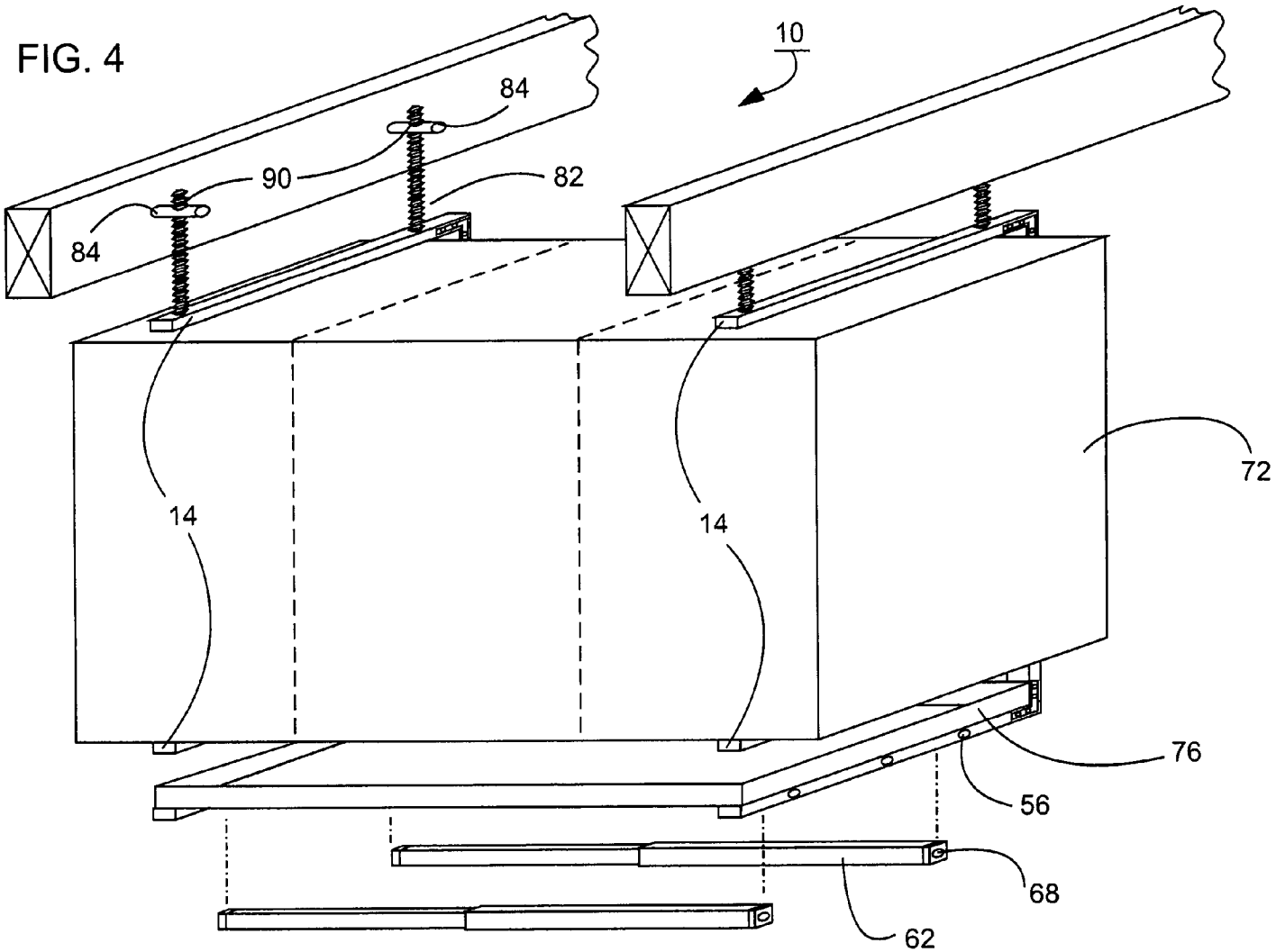
FIG. 4 is a perspective illustration, partly exploded, of an air conditioning support system constructed in accordance with the principles of the present invention.

With reference now to the drawings, and in particular to FIG. 1 thereof, the preferred embodiment of the new and improved air handler support system embodying the principles and concepts of the present invention and generally designated by the reference numeral 10 will be described.

The present invention, the air handler support system 10 is comprised of a plurality of components. Such components in their broadest context include two upper brackets each formed of an inverted L-shaped fixed component and an L-shaped adjustable component. Such components are individually configured and correlated with respect to each other so as to attain the desired objective.

Two similarly configured upper brackets 14 are provided. Each upper bracket is formed of an inverted L-shaped fixed component 16 above and an L-shaped adjustable component 18.

Each fixed component has a horizontal leg 20 above and a vertical leg 22 below. Bolt plates 24 are secured to the horizontal and vertical legs for retention purposes. Each horizontal leg has two laterally spaced vertical support holes 26. Each vertical leg has four elevationally space adjustment holes 28.

Each adjustable component has a horizontal leg 30 below and a vertical leg 32 above. Bolt plates 34 are secured to the horizontal and vertical legs for retention purposes. Each vertical leg has two laterally spaced horizontal support holes 36 adjacent to the horizontal leg. Each vertical leg has two elevationally space adjustment holes 38. Each leg is tubular with a square cross sectional configuration and is sized to allow the vertical leg of each adjustable component to slidably receive the vertical leg of an associated fixed component to align the holes in the legs selectively for larger and smaller air conditioning components adapted to be supported. A pair of adjustment bolts 40 are provided. The adjustment bolts extend through aligned holes of the vertical legs of the fixed and adjustable components. A nut is provided for each bolt. The horizontal leg of each adjustable component has an upper surface with spaced elastomeric vibration isolator pads 42. In this manner an upper support surface for supporting air conditioning components is provided.

Two similarly configured L-shaped supplemental components 46 are next provided. The L-shaped supplemental components have a horizontal leg 48 below and a vertical leg 50 above. Bolt plates 52 are secured to the horizontal and vertical legs for retention purposes. Each vertical leg has two elevationally spaced horizontal support holes 54 adjacent to the horizontal leg. Each horizontal leg has three laterally spaced support holes 56. A pair of securement bolts 58 is provided.

The securement bolts extend through aligned holes of the vertical legs of the supplemental components and the adjustable components. A nut is provided for each bolt.

Next provided is at least one telescoping cross brace 62. Each telescoping cross brace is formed of two segments 64, 66. Each segment is tubular with a square cross sectional configuration and is sized to allow the one segment of each of the cross braces to slidably receive the other segment for varying the length of the cross braces. All of the cross brace segments have an open end with a threaded insert 6B positioned in axial alignment with one of the support holes in the horizontal leg of the supplemental component to provide a lower support surface. All of the cross brace segments and all of the legs of the components are fabricated of a high carbon steel of a grade and size selected for a particular application.

Next provided is an air handler 72. The air handler is positioned upon the upper support surface. The air handler is totally accessible for maintenance and replacement from the side opposite from the vertical legs of the brackets.

A drain pan 76 is next provided. The drain pan is positioned upon the lower support surface. The drain pan is totally accessible for maintenance and replacement from the side opposite from the vertical legs of the brackets. A drain pan support pin 78 is provided on the vertical leg of each supplemental component above the horizontal leg. The support pin removably retains the drain pan in an operative orientation beneath the air handler.

Lastly, a suspension assembly is provided. The suspension assembly includes two vertically oriented threaded rods 82. The threaded rods have lower ends extending through the vertical holes of the horizontal leg of each fixed component. An associated nut is beneath the horizontal legs for support. Four hanger bolts 84 are provided. Each hanger bolt has a threaded end 86 which is extendable horizontally into a rafter and a free end 88 with a vertical threaded aperture 90 for threadedly receiving and supporting the upper end of the threaded rod.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An air handler support system comprising:

two similarly configured upper brackets formed of an inverted L-shaped fixed component above and an L-shaped adjustable component below;

each fixed component having a horizontal leg above and a vertical leg below, each horizontal leg having laterally spaced vertical support holes, each vertical leg having elevationally space adjustment holes;

each adjustable component having a horizontal leg below and a vertical leg above, each vertical leg having laterally spaced horizontal support holes adjacent to the horizontal leg, each vertical leg having elevationally space adjustment holes, each leg being sized to allow the vertical leg of each adjustable component to slidably receive the vertical leg of an associated fixed component to align the holes in the legs selectively with adjustment elements extending through aligned holes, the horizontal leg of each adjustable component having an upper surface to provide an upper support surface for air conditioning components; and two similarly configured L-shaped supplemental components having a horizontal leg below and a vertical leg above, each vertical leg having elevationally spaced horizontal support holes adjacent to the horizontal leg, a pair of securement members extending through aligned holes of the vertical legs of the supplemental components and the adjustable components.

2. The system as set forth in claim 1 and further including:

at least one telescoping cross brace formed of two segments with each segment being tubular with a square cross sectional configuration and sized to allow the one segment of each of the cross braces to slidably receive the other segment for varying the length of the cross braces, all of the cross brace segments having an open end with a threaded insert positioned in axial alignment with a hole in the vertical leg of the supplemental component with an associated bolt to provide a lower support surface, all of the cross brace segments and all of the legs of the components being fabricated of a high carbon steel of a grade and size selected for a particular application.

3. The system as set forth in claim 2 and further including:

an air handler positioned upon the upper support surface totally accessible for maintenance and replacement from the side opposite from the vertical legs of the brackets; and a drain pan positioned upon the lower support surface totally accessible for maintenance and replacement from the side opposite from the vertical legs of the brackets, and a drain pan support pin on the vertical leg of each supplemental component above the horizontal leg for removably retaining the drain pan in an operative orientation beneath the air handler.

4. An air handler support system comprising:

two similarly configured upper brackets formed of an inverted L-shaped fixed component above and an L-shaped adjustable component below;

each fixed component having a horizontal leg above and a vertical leg below, each horizontal leg having laterally spaced vertical support holes, each vertical leg having elevationally space adjustment holes;

each adjustable component having a horizontal leg below and a vertical leg above, each vertical leg having laterally spaced horizontal support holes adjacent to the horizontal leg, each vertical leg having elevationally space adjustment holes, each leg being sized to allow the vertical leg of each adjustable component to slidably receive the vertical leg of an associated fixed component to align the moles in the legs selectively with adjustment elements extending through aligned holes, the horizontal leg of each adjustable component having an upper surface to provide an upper support surface for air conditioning components; and a suspension assembly including two vertically oriented threaded rods having lower ends extending through the vertical holes of the horizontal leg of each fixed component with an associated nut beneath the horizontal legs for support, four hanger bolts, each with a threaded end extendable horizontally into a rafter and a free end with a vertical threaded aperture threadedly receiving and supporting the upper end of the threaded rod.

5. An air handler support system for suspending from above air handler components of an air conditioner in a safe, convenient and economical manner comprising, in combination:

two similarly configured upper brackets formed of an inverted L-shaped fixed component above and an L-shaped adjustable component below;

each fixed component having a horizontal leg above and a vertical leg below, bolt plates secured to the horizontal and vertical legs for retention purposes, each horizontal leg having two laterally spaced vertical support holes, each vertical leg having four elevationally space adjustment holes;

each adjustable component having a horizontal leg below and a vertical leg above, bolt plates secured to the horizontal and vertical legs for retention purposes, each vertical leg having two laterally spaced horizontal support holes adjacent to the horizontal leg, each vertical leg having two elevationally space adjustment holes, each leg being tubular with a square cross sectional configuration and sized to allow the vertical leg of each adjustable component to slidably receive the vertical leg of an associated fixed component to align the holes in the legs selectively for larger and smaller air conditioning components adapted to be supported, a pair of adjustment bolts extending through aligned holes of the vertical legs of the fixed and adjustable components with a nut for each bolt, the horizontal leg of each adjustable component having an upper surface with spaced elastomeric vibration isolator pads to provide an upper support surface for supporting air conditioning components;

two similarly configured L-shaped supplemental component having a horizontal leg below and a vertical leg above, bolt plates secured to the horizontal and vertical legs for retention purposes, each vertical leg having two elevationally spaced horizontal support holes adjacent to the horizontal leg, each horizontal leg having three laterally spaced support holes, a pair of securement bolts extending through aligned holes of the vertical legs of the supplemental components and the adjustable components with a nut for each bolt;

at least one telescoping cross brace formed of two segments with each segment being tubular with a square cross sectional configuration and sized to allow the one segment of each of the cross braces to slidably receive the other segment for varying the length of the cross braces, all of the cross brace segments having an open end with a threaded insert positioned in axial alignment with one of the support holes in the horizontal leg of the supplemental component to provide a lower support surface, all of the cross brace segments and all of the legs of the components being fabricated of a high carbon steel of a grade and size selected for a particular application;

an air handler positioned upon the upper support surface totally accessible for maintenance and replacement from the side opposite from the vertical legs of the brackets;

a drain pan positioned upon the lower support surface totally accessible for maintenance and replacement from the side opposite from the vertical legs of the brackets, and a drain pan support pin on the vertical leg of each supplemental component above the horizontal leg for removably retaining the drain pan in an operative orientation beneath the air handler; and a suspension assembly including two vertically oriented threaded rods having lower ends extending through the vertical holes of the horizontal leg of each fixed component with an associated nut beneath the horizontal legs for support, four hanger bolts, each with a threaded end extendable horizontally into a rafter and a free end with a vertical threaded aperture threadedly receiving and supporting the upper end of the threaded rod.

* * * * *